US005134422A

United States Patent [19]

Auriol

[11] Patent Number: 5,134,422

[45] Date of Patent: Jul. 28, 1992

[54] HELICAL TYPE ANTENNA AND MANUFACTURING METHOD THEREOF

[75] Inventor: Albert Auriol, Roquettes, France

[73] Assignee: Centre National d'Etudes Spatiales, Paris, France

[21] Appl. No.: 277,284

[22] Filed: Nov. 29, 1988

[30] Foreign Application Priority Data

Dec. 10, 1987 [FR] France ..... 87 17218

[51] Int. Cl.[5] ..... H01Q 1/38; H01Q 11/08

[52] U.S. Cl. ..... 343/895; 343/897

[58] Field of Search ..... 343/700 MS File, 705, 343/895, 897; 29/600

[56] References Cited

U.S. PATENT DOCUMENTS

| | | | |
|---|---|---|---|
| 2,945,227 | 7/1960 | Broussaud | 343/895 |
| 3,381,371 | 5/1968 | Russell | 343/895 |
| 3,508,269 | 4/1970 | Snyder | 343/895 |
| 3,573,840 | 4/1971 | Gouillou et al. | 343/895 |
| 3,778,839 | 12/1973 | Kovar | 343/895 |
| 4,008,479 | 2/1977 | Smith | 343/895 |
| 4,012,744 | 3/1977 | Greiser | 343/895 |
| 4,114,164 | 9/1978 | Greiser | 343/895 |
| 4,349,824 | 9/1982 | Harris | 343/700 MS |
| 4,525,720 | 6/1985 | Corzine et al. | 343/895 |
| 4,847,627 | 7/1989 | Knight | 343/705 |

FOREIGN PATENT DOCUMENTS 2187043 8/1987 United Kingdom .

OTHER PUBLICATIONS

IEEE Transactions . . . Propagation, vol. AP-19, No. 4, Juillet 1971, pp. 547-548; A. T. Adams et al.: "Optimization . . . Helix Antena".

IEE Proceedings . . . And Antennas, vol. 128, No. 1, Partie H., Febrier 1981, pp. 26-34, Old Woking . . . GB; P. S. Hall et al.: Design . . . Corp.

Patent Abstracts of Japan, vol. 6, No. 185 (E-132) (1063), Sep. 21, 1982; & JP-A-57 99 006 (Nippon Denki K.K) Jun. 19. 1982.

*Primary Examiner*—Michael C. Wimer

*Attorney, Agent, or Firm*—Ladas & Parry

[57] ABSTRACT

A helical type of antenna has at least one radiating cord, helically wound in a rotational shape. The antenna has a circuit for the supply of the radiating cords formed by a strip line type of transmission line which fulfills both the supply distribution function and the function of matching the radiating cords of the antenna.

13 Claims, 6 Drawing Sheets (SECTION A-A)

HELICAL TYPE ANTENNA AND MANUFACTURING METHOD THEREOF

BACKGROUND OF THE INVENTION

1. Field of the Invention

The invention concerns a helical type antenna and the method of its manufacture.

Helical type antennas have the advantage of radiating an electromagnetic wave in high quality circular polarization on a wide coverage and with a transmission lobe which may be shaped as the case may be.

These characteristics make these antennas valuable in many fields of use, particularly in ground links with orbiting satellites or in mobile/relay ground links with geosynchronous satellites.

However, this type of antenna generally has four radiating cords which have to be supplied according to adequate amplitude and phase relationships. Thus, FIG. 1 a shows the four radiating cords wound on a circular sleeve with a pitch p around a directrix of the sleeve, corresponding to an angular shift of $$\frac{\pi}{2} \cdot rd.$$

and each cord is supplied with a signal having a relative, successive, angular phase shift equal to $$\frac{\pi}{2}.$$

For a radiating cord A 0°, supplied with a null relative phase signal, marked 0° in FIG. 1*a*, the radiating cords, successively marked A-90°, A-180°, A-270°, are supplied with signals of the same amplitude A but with successive phases at −90°, −180°, −270°.

2. Description of the Prior Art

To set up the supply of antennas of this type, various methods have been proposed until now.

According to a first method, as shown in FIG. 1*c*, the excitation is done, firstly, through a hybrid coupler, which divides the energy into two equal amplitude channels, phase shifted with respect to each another by 90°. A double symmetrizer, housed in the shaft of the antenna, enables the passage, for each of the two channels, from the coaxial line to the diametrically opposite cords. These latter cords are therefore supplied by equal amplitudes in phase opposition. The use of a compensated symmetrizer makes it possible to adjust the operational range of frequency of the antenna.

In a second method, as shown in FIG. 1*d* and as in the case of FIGS. 1*b* and 1*c*, the hybrid coupler enables the energy to be separated into two equal amplitude channels in phase quadrature.

The energy is then conveyed to the supply point by two of the radiating cords which are, in fact, formed by coaxial cables. Then it gets divided, with equal amplitudes and in phase opposition, between the diametrically opposite cords, a first part being connected to the cores of the coaxial cables and another part being formed by the external part of the sheathing of the coaxial cables themselves.

As compared with the previous approach according to FIGS. 1*b* and 1*c*, this approach has the advantage of eliminating the central symmetrizer. However, its frequency characteristic curve is narrower because of the absence of any setting.

According to a third approach, as shown in FIG. 1*e*, the coaxial supply line is split at its end to form a symmetrizer. The distribution of the energy in quadrature between the two bi-helical elements is achieved by adjusting the length, and hence the reactance, of the radiating cords.

This approach makes it possible, advantageously, to eliminate the hybrid coupler, but it calls for the delicate setting of the length of the cords. Furthermore, since these cords have different lengths, the geometry of the antenna no longer has rotational symmetry, and the making of the antenna is more complicated.

According to a fourth approach, as shown in FIG. 1*f*, which is the simplest approach from the theoretical point of view, the radiating cords are supplied by a distributor.

These distributor circuits are formed by discrete elements which have to be connected to the antenna by four connections, and it is sometimes difficult to adapt this approach to the geometry of the antenna.

In all the above-mentioned cases, the other end of the cords, with respect to the end forming the supply point, is either in an open circuit, in which case the length of the cords is equal to an odd whole number of quarter wavelengths, or it is a short circuit with a length of cords equal to a whole number of half wavelengths. In practice, a true open circuit is impossible to achieve, unlike an efficient short circuit. This is why the four cords are generally short circuited together at the end opposite to the supply point, and the short circuit is made in the shape of a cross as shown in FIG. 1*g*.

SUMMARY OF THE INVENTION

An object of the present invention is to overcome the above-mentioned disadvantages by the application of an especially simple helical antenna structure.

Another object of the present invention is the application of a particularly light and compact helical type antenna.

Another object of the present invention is the application of a helical type antenna with high reproducibility of radiation graph characteristics.

Finally, yet another object of the present invention is the application of a particularly simple method to manufacture a helical type antenna which can be very easily adapted to industrial scale manufacture, with excellent qualities of reproducibility and automation.

The helical type antenna according to the invention has at least one radiating cord, helically wound in rotational shape. An outstanding feature of said antenna is that it has a supply circuit, for said radiating cord or cords, formed by a strip line type of transmission line fulfilling both the supply distribution function and the function of adapting the radiating cords of the antenna.

An outstanding feature of the method for manufacturing a helical type antenna according to the invention is that it consists in stamping a double-sided, flexible printed circuit sheet with dimensions corresponding to a sleeve of a rotational shape, on said printed circuit, demarcating a first zone designed to contain said strip line and a second zone designed to contain said radiating cords on a first face of the printed circuit, in removing the metallization at the level of said second zone, said metallization being kept on the entire first zone to form a reference propagation plane on the second face of said printed circuit, in forming, by the removal of material, firstly, at the second zone of said metallization in defined zones, of said radiating cords and of a ring-shaped conducting zone and, secondly, at the first zone, of a conducting zone, forming said strip line with said propagation reference plane, in winding the printed circuit sheet on the reference propagation plane side or on the side of the cords on the sleeve, these radiating cords being suitably oriented.

The invention can be applied to the manufacture and making of helical type antenna used in ground/orbital satellite telecommunication links or in mobile/relay telecommunications links with geosynchronous satellites, and for radiolocation.

BRIEF DESCRIPTION OF THE DRAWINGS

The invention will be better understood from the following description and the appended drawings of which, apart from FIGS. 1*a* to 1*g* relating to the prior art.

DESCRIPTION OF PREFERRED EMBODIMENTS

The antenna according to the invention is a helical type antenna having at least one radiating cord which is helically wound in a rotational form.

Figure 2A:
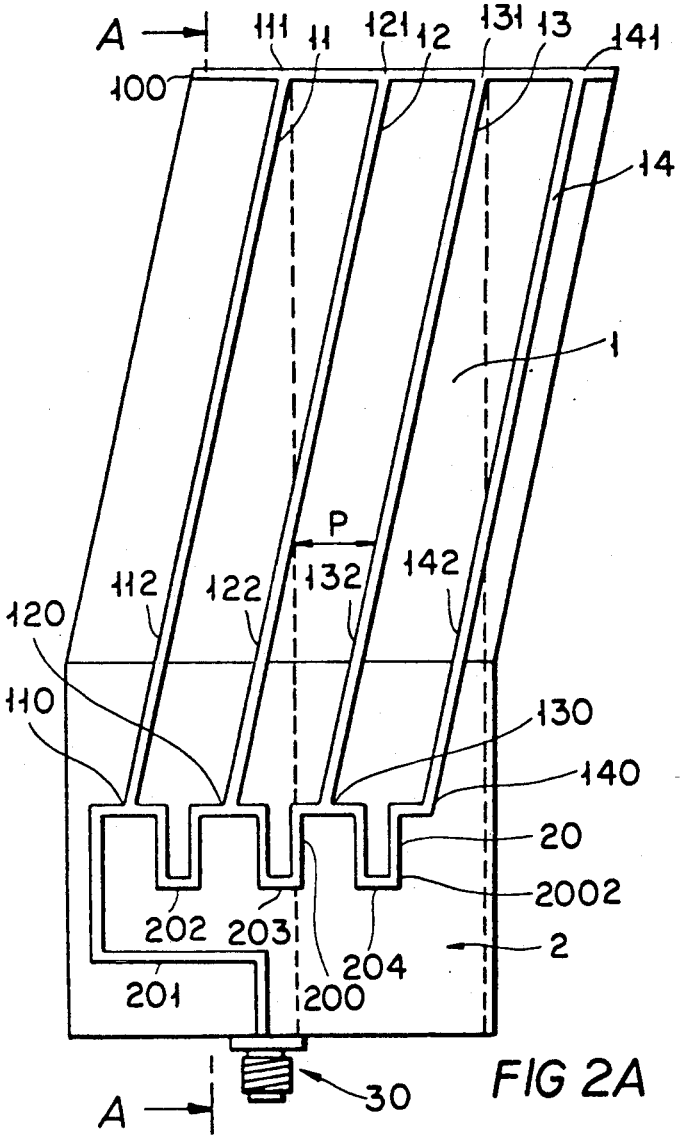
FIG. 2*a* shows an evolute view of a helical type of antenna according to the present invention.
Figure 2B:
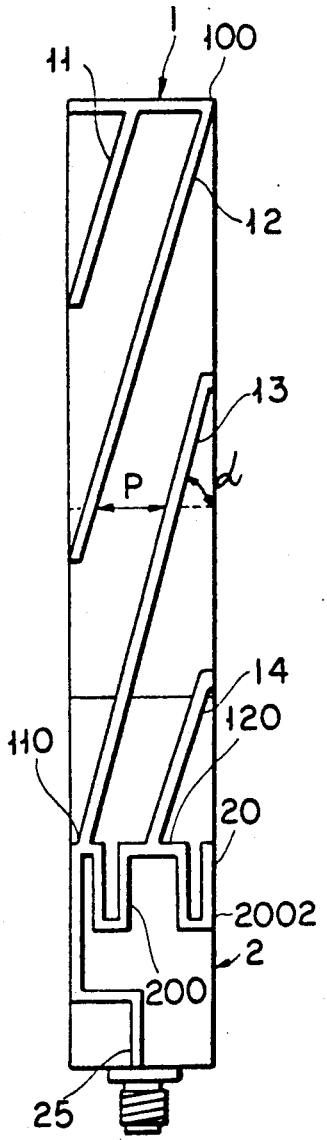
FIG. 2*b* shows a front view of an antenna according to the object of the invention.
Figure 2C:
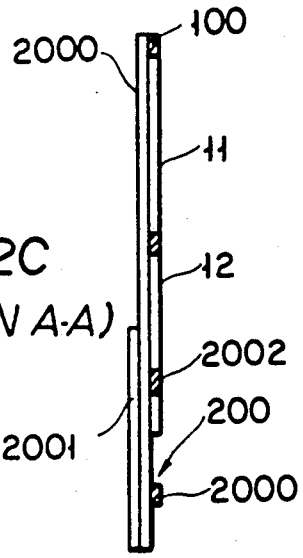
FIG. 2*c* shows a cross section, along the sectional plane AA of FIG. 2*a*.

It shall be described, first of all, with reference to FIGS. 2*a*, 2*b* and 2*c*, the rotational form being cylindrical.

According to the above-mentioned figures, the helical type antenna according to the invention has at least one radiating cord marked 11, 12, 13 or 14, helically wound in a circular form around a sleeve 1, for example. In FIG. 2*a*, which shows an evolute view of an antenna according to a special embodiment of the invention, dotted lines are used to represent the sleeve 1 on which the antenna is normally wound to form the antenna which is effectively obtained as shown in FIG. 2*b*.

According to an especially advantageous characteristic of the helical type antenna according to the invention, this antenna has a supply circuit 2 for the radiating cord or cords. This circuit consists of a strip line type of transmission line marked 20. The strip line 20 fulfils both the supply distribution function and that of the impedance matching of the radiating cords of the antenna.

In the particular embodiment shown in FIGS. 2*a*, 2*b* and 2*c*, the helical type antenna according to the invention has four radiating cords, marked 11, 12, 13 and 14. Each radiating cord consists of a metallized zone in the form of a strip which is helically wound on the lateral surface of the sleeve 1. Each strip forming the radiating cords 11, 12, 13 and 14 is at a distance from the next one, along a directrix of the sleeve 1, by a defined distance P. Thus, as shown in FIG. 2*b*, the radiating cords are inclined by an angle $\alpha$ with reference to any directrix of the sleeve 1, and are thus helically wound.

According to an advantageous characteristic of the supply circuit 2, the transmission line 20, forming this supply circuit, may be advantageously formed by a meandering line marked 200 in FIGS. 2*a* and 2*b*. Each radiating cord 11, 12, 13 and 14 is, at its supply point, marked 110, 120, 130, 140, or its input end, connected so as to be in electrical contact with the strip forming the meandering line 200. According to an advantageous characteristic of the supply circuit of the antenna according to the invention, the electrical distance on the meandering line, between two input points of two consecutive radiating cords, with input points such as 110, 120, 130 and 140, is equal to an odd value multiple of a quarter wavelength of the transmission/reception signal propagated in the strip line considered.

Figure 1A:
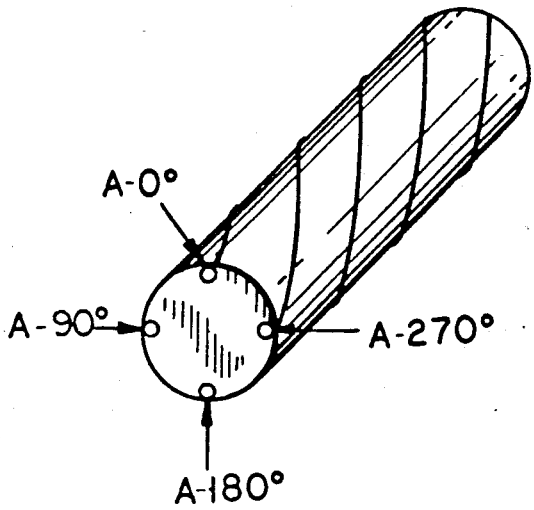
FIG. 1A PRIOR ART
Figure 1B:
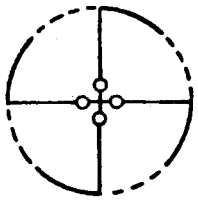
FIG 1B PRIOR ART
Figure 1C:
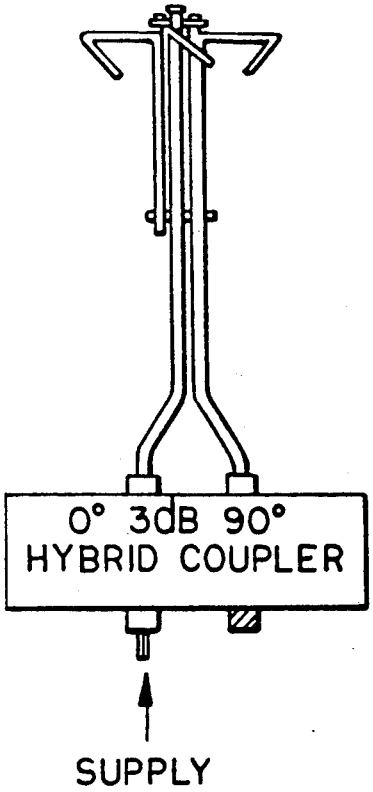
FIG 1C PRIOR ART
Figure 1D:
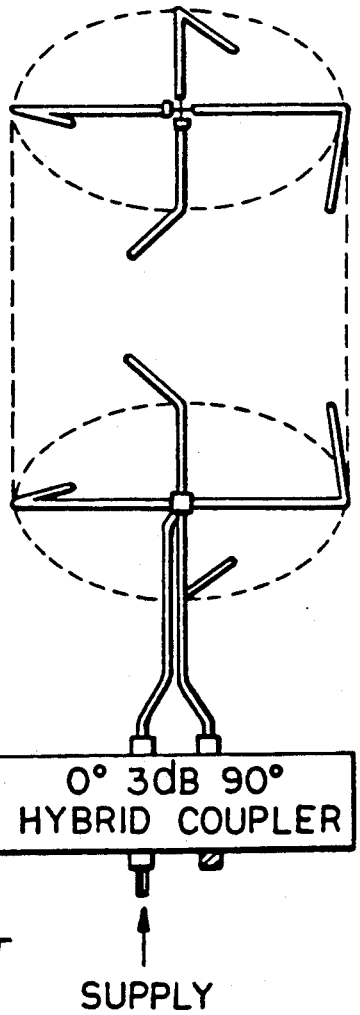
FIG. 1D PRIOR ART
Figure 1E:
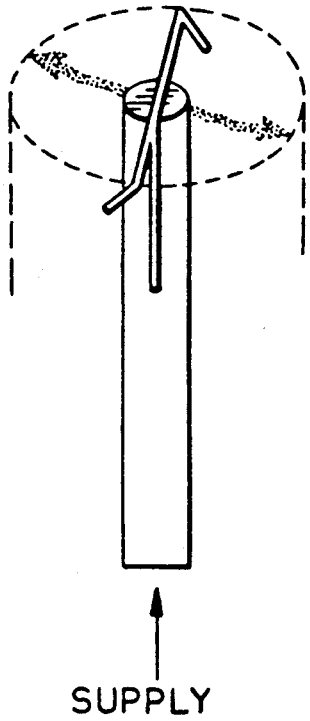
FIG. 1E PRIOR ART
Figure 1F:
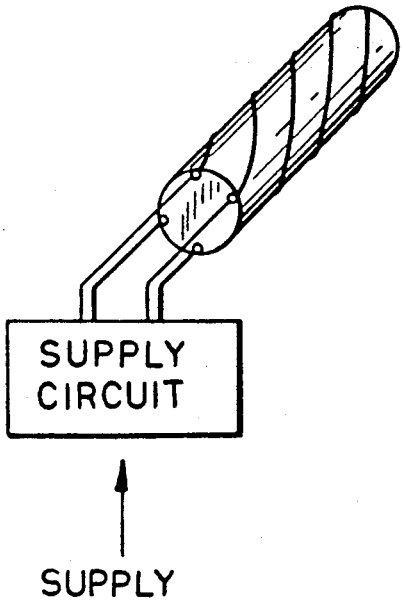
FIG. 1F PRIOR ART
Figure 1G:
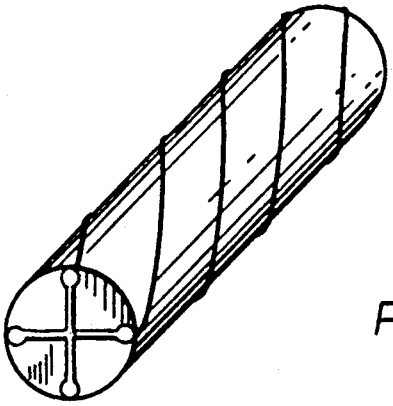
FIG. 1G PRIOR ART

Under these conditions, especially when the odd value multiple of quarter wavelengths is equal to 1, each supply point or input point 110, 120, 130 and 140 of the radiating cords 11, 12, 13 and 14 is supplied by signals of equal amplitude respectively phase shifted by $\pi/2$.rd, i.e. under conditions of supply as shown in FIG. 1*a*.

Figure 2D:
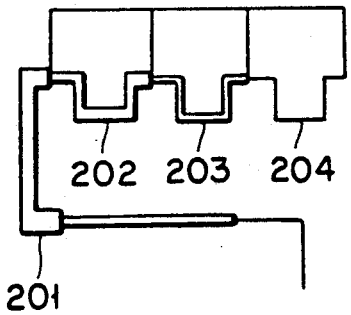
FIG. 2*d* shows a detailed view of an embodiment of FIG. 2*a*.

The radiating cord matching function can be advantageously fulfilled by the use of line sections 201, 202, 203, 204 of variable width, thus forming the line 20 as shown in FIG. 2*d*, and by sections 110 to 112, 120 to 122, 130 to 132 and 140 to 142, of the radiating cords.

According to another advantageous characteristic of the helical type antenna of the invention, the ends of the cords opposite to the input ends 110, 120, 130, 140, i.e. the ends marked 111, 121, 131, 141 in FIGS. 2*a* and 2*b*, is advantageously connected in a short circuit to a same ring-shaped conducting zone 100. As will be easily understood, depending on the phase conditions of the supply signal at the entry point 110, 120, 130, 140 of each radiating cord 11, 12, 13, 14, one of the ends of one of the radiating cords 111, 121, 131, 141, is necessarily in a short circuit, i.e. with a null electrical field amplitude, and all the opposite ends 111, 121, 131, 141, through the connection to the conducting zone, are thus short circuited. The ring-shaped conducting zone 100 thus imposes a short circuit at the end of the four radiating cords 11, 12, 13 and 14.

As is further shown in FIG. 2*c*, along a section following the sectional plane AA of FIG. 2*a*, the strip line 200 forming the supply circuit 2 has a sheet of dielectrical material 2000, a first face of which, designed to be applied to the lateral surface of the sleeve 1, is entirely metallized to form a reference propagation plane, marked 2001. A second face of the sheet of dielectrical material 2000, opposite to the first face, has a metallic strip 2002 forming the strip line 20 with the first metallized face 2001.

As is further shown in FIG. 2*c*, in an especially advantageous manner, the supply circuit 2 formed by a strip line 2, radiating cords 11, 12, 13 and 14 and the ring-shaped conducting zone 100 in short circuit, are formed on one and the same sheet of dielectrical material.

FIG. 2*b* shows a front view of the antenna obtained after assembly, namely after winding the sheet of dielectric material 2000, provided with its different conducting zones, around the sleeve 1.

A method for making a helical type antenna, according to the object of the invention, shall be described with reference to FIGS. 3 and 4 and, especially, with reference to FIG. 3 at the points a, b, c, d, of this figure.

In order to achieve industrial scale manufacturing of a helical type antenna according to the invention, the manufacturing method may consist, as shown at the point (a) of FIG. 3, in stamping a sheet 10 of a double-sided flexible printed circuit, the two sides being marked 101, 102, and being provided with a metallization with corresponding dimensions for a cylindrical sleeve 1 of a given dimension. Of course, the printed circuit sheet may consist of a high quality sheet with dielectrical material sheet 2000 consisting, for example, of a sheet of plastic material such as Kapton (polyimide) or glass-reinforced polytetrafluorethylene.

As is also shown at the point (a) of FIG. 3, the method may then consist in demarcating, on the printed circuit sheet 10, a first zone marked I designed to contain said strip line and a second zone marked II, designed to contain the radiating cords.

As shown in FIG. 3, at the point (b) of this figure, the manufacturing method then consists in eliminating, on a first face of the printed circuit 10, particularly at the second zone marked II, the metallization 101 for example, this very same metallization 101 being kept on the entire first zone of the first face to form the reference propagation plane marked 2001.

As is also shown at the point (c) of FIG. 3, the embodiment then consists in forming, firstly, by the removal of material on the second face of the printed circuit 10, at the second zone of the metallization 102, in defined zones, the radiating cords 11, 12, 13 and 14 and the ring-shaped conducting zone 100. In the same way, at the first zone, secondly, there is then formed a conducting zone which constitutes, with the reference propagation plane 2001, the strip line 20. The above-mentioned conducting zone may then be formed by a conducting zone marked 200, forming the meandering line.

Figure 3A:
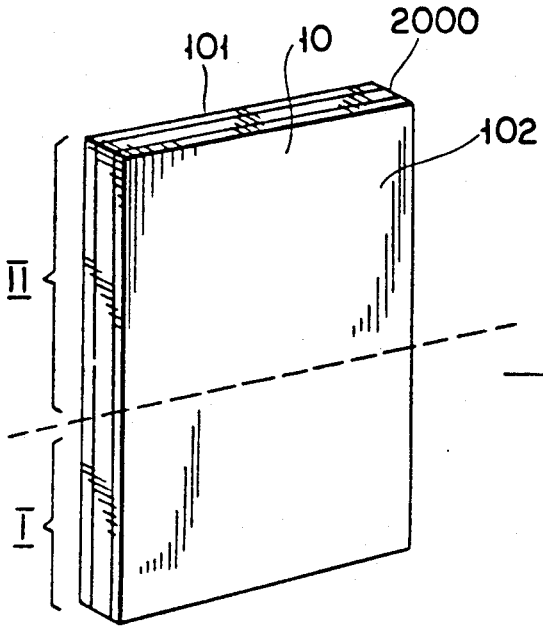
FIG. 3 shows, in a), b), c) and d), the various steps of a method for manufacturing an antenna according to the object of the invention.
Figure 3B:
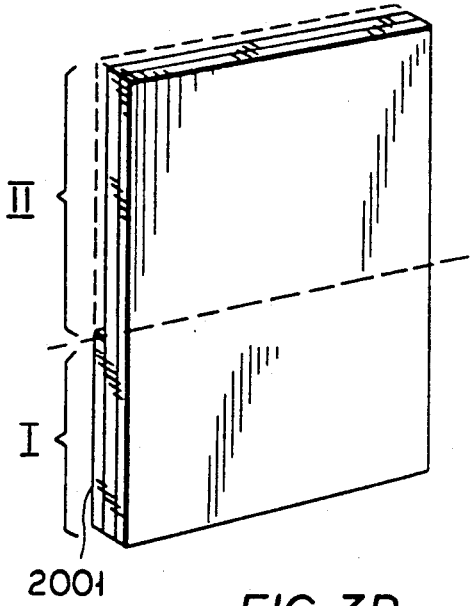
Figure 3C:
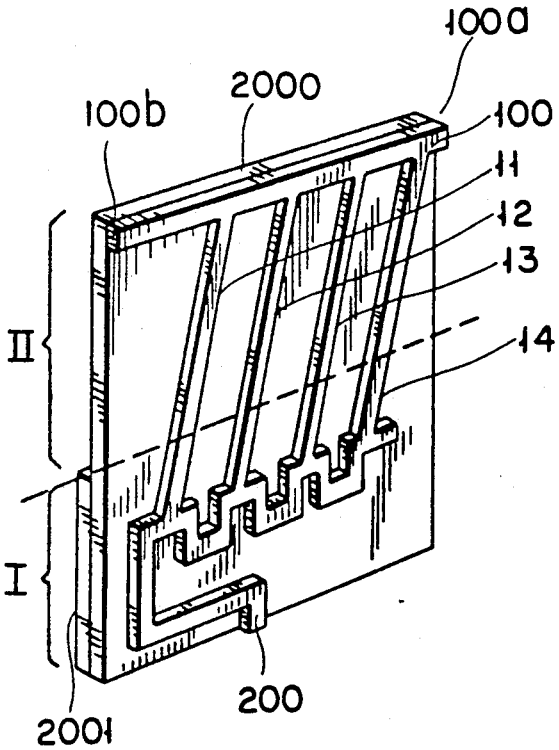
Figure 3D:
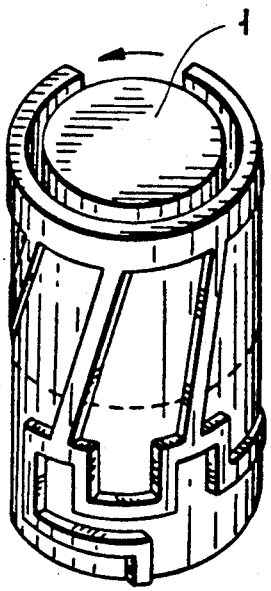

As shown at the point (d) of FIG. 3, the sheet thus obtained in FIG. 3*c*, provided with its different conducting zones, is then wound on the sleeve 1, the reference propagation plane 2001 side or the cords side being attached to the lateral surface of the sleeve 1. The sleeve may then be either withdrawn or not withdrawn. Of course, the radiating cords 11, 12, 13 and 14 are suitably oriented.

The different steps shown in FIG. 3, at the points a, b, c, of this figure, are in an advantageous and standard manner, achieved by masking, insolation and then chemical attacking process. Of course, the stage shown at the point c of FIG. 3 may advantageously be achieved by one and the same mask.

Advantageously, the step in which the double-sided flexible printed circuit sheet 10 is stamped to the corresponding dimensions of the cylindrical sleeve 1 may advantageously be achieved by stamping with an appropriate stamping tool.

Figure 4A:
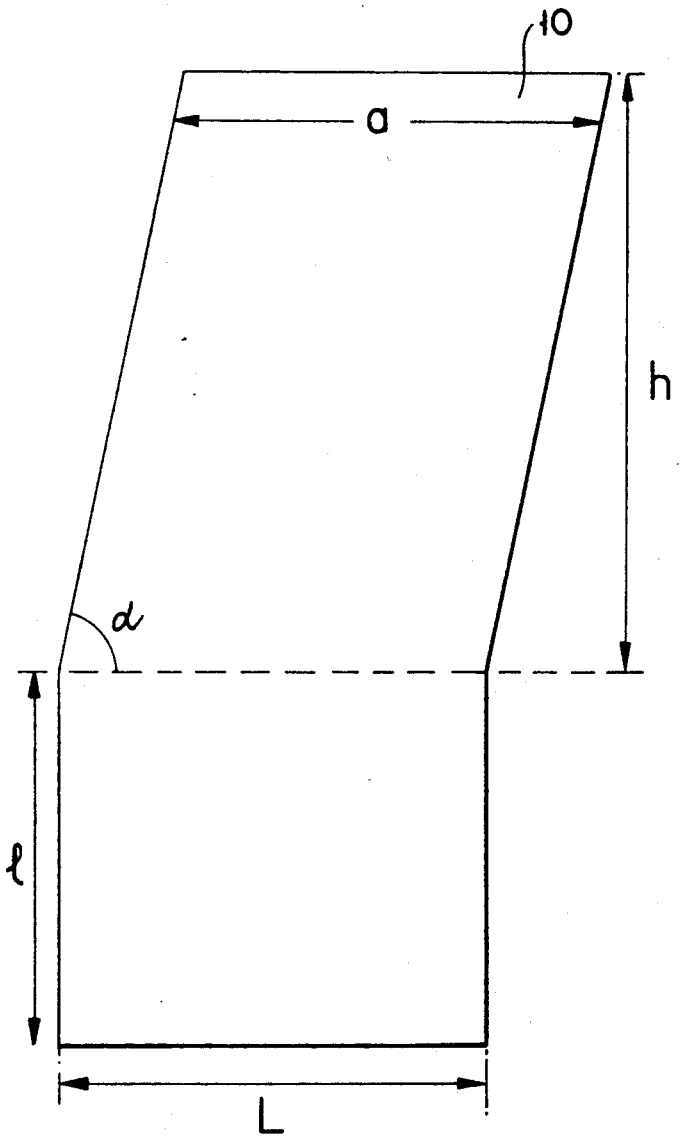
FIGS. 4*a* and 4*b* show an advantageous operational mode for implementing the method of FIG. 3.
Figure 4B:
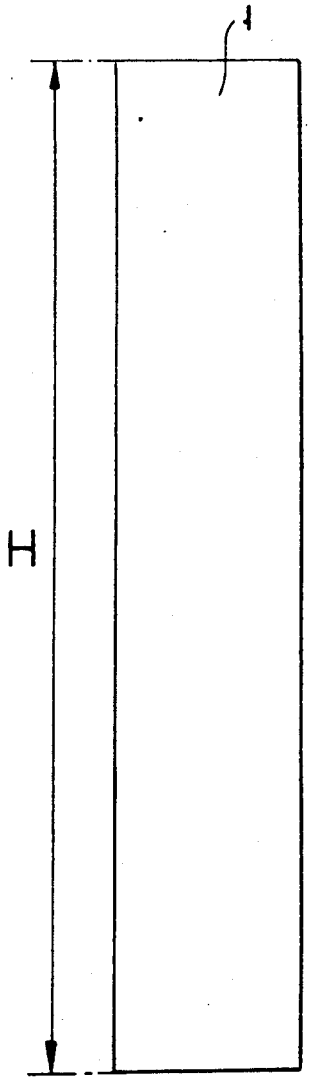

As is further shown in FIGS. 4*a* and 4*b*, advantageously, the stamping of the two-sided printed circuit sheet 10 to the dimensions corresponding to that of the sleeve 1, may consist, for example, in stamping the above-mentioned sheet along a contour, the shape of which corresponds to that of a rectangle with a length L corresponding to the perimeter of the section of the sleeve 1, and with a width 1 of a defined value. Furthermore, this shape includes a parallelogram superimposed on the above-mentioned rectangle. This parallelogram has a small side marked a corresponding to the length L of the above-mentioned rectangle and its height h is such that the width 1 of the rectangle plus the height h of the parallelogram is equal to the height H of the sleeve 1, as shown in FIGS. 4*a* and 4*b*, the sleeve 1 with a substantially corresponding dimension being shown facing the stamped printed circuit sheet. Of course, the angle of the parallelogram corresponds to the helically wound angle of the radiating cords on the sleeve 1, the radiating cords 11, 12, 13 and 14 being then formed, as described above, parallel to the corresponding sides of the above-mentioned parallelogram.

After the winding of the antenna, it is necessary to provide the electrical contact of the ends 100*a*, 100*b*, of the ring-shaped zone 100 by soldering, riveting or bonding with a conductive bonder. An adequate connector 30 may then be positioned at the end 25 of the line 20 by a standard technique such as screwing, clamping, soldering or bonding.

Figure 5B:
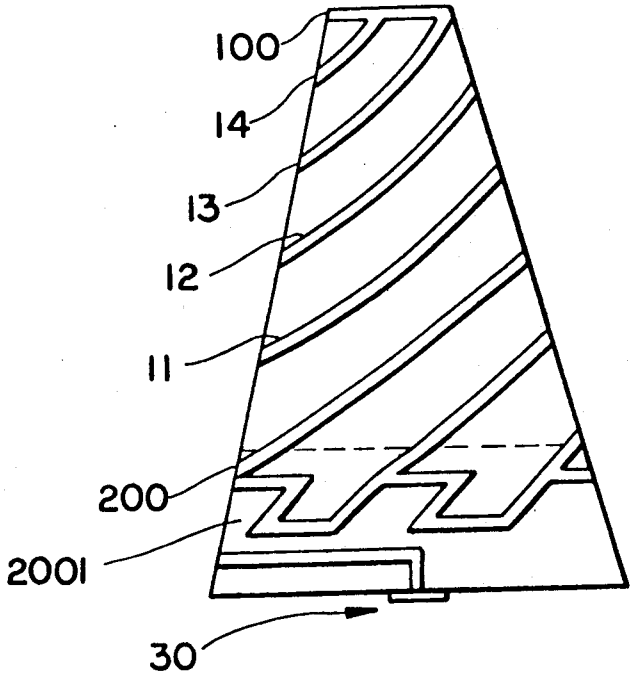
FIG. 5*b* shows a conical shaped helical type antenna obtained by means of the printed circuit of FIG. 5*a*.
Figure 5A:
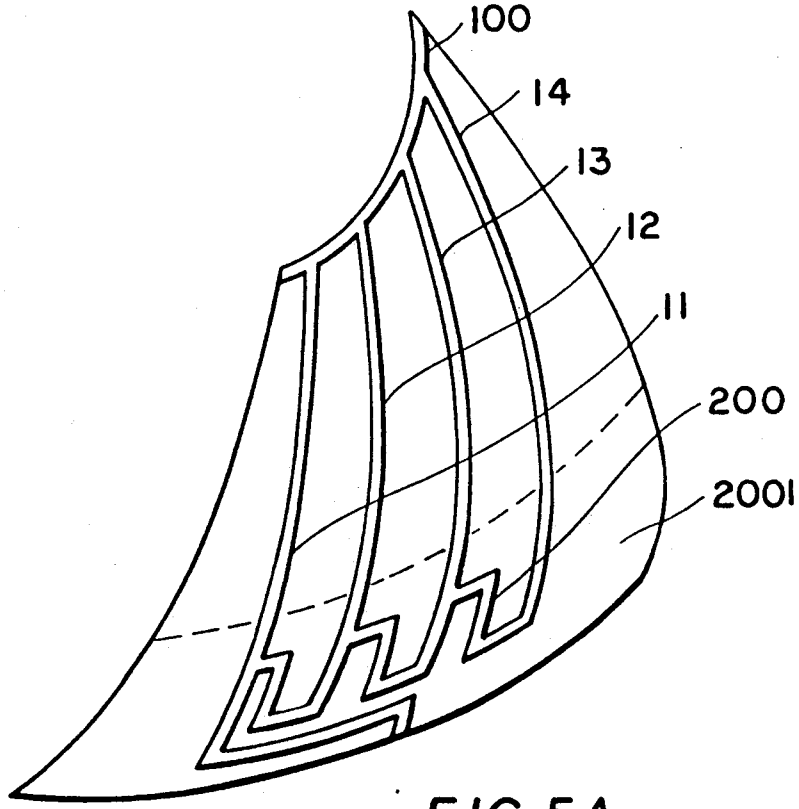
FIG. 5*a* shows an flat evolute view of a printed circuit enabling the implementation of a conical shaped helical type antenna.

The helical type antenna according to the invention may also, as shown in FIGS. 5*a* and 5*b*, comprise at least one radiating cord 11, 12, 13, and 14, helically wound in a conical rotational form.

FIG. 5*a* shows the flat evolute shape of the printed circuit which corresponds to the conically-shaped sleeve used.

The method according to the invention, in its different steps for the etching of the supply circuit 200 for the radiating cords 11, 12, 13, 14 and the final short circuit 100, if any, may of course be applied to any antenna with a developable shape and, especially, to conical-shaped helical antennas.

These antennas, as compared with cylindrical antennas, have higher quality circular polarization in coverage, and a lower level of spillover radiation on the connector side. By contrast, their bulk is greater for equal frequencies, and the evolute circuit has a more complex shape as shown in FIG. 5*a*.

The manufacturing method differs from that of cylindrical helical antennas only in the special shape of the evolute circuit and in the form in which it is wound.

We have thus described a helical type antenna and its industrial scale manufacture in an especially advantageous embodiment. For, owing to its design, the antenna according to the invention is highly reproducible in its mechanical as well as its electromagnetic characteristics. Furthermore, because of the design of the helical type antenna according to the invention, it has been possible to define an implementing and manufacturing method enabling the production of this type of antenna on an industrial scale with very high standards of reliability.

What is claimed is:

1. A helical type antenna comprising a plurality of radiating cords, said cords being wound onto a sleeve in a rotational shape, wherein said antenna has a single transmission line to supply all the radiating cords present on the sleeve, said transmission line consisting of a strip line above a ground plane, said strip line and ground plane being located on said sleeve and said transmission line performing both the power distribution function and the function of impedance matching the radiating cords of the antenna.

2. A helical type antenna, as claimed in claim 1, wherein said sleeve is cylindrical.

3. A helical type antenna, as claimed in claim 1, wherein said sleeve is conical.

4. A helical type antenna according to claim 1 wherein said sleeve comprises a sheet of a dielectric material, one side of said sheet having a portion entirely metallized to form a reference propagation plane, and the other side of said sheet opposite to said metallized portion having a metal meandering line thereon forming said transmission line.

5. A helical type antenna according to claim 1, wherein each one of said cords has an input end connected to said circuit, a ring-shaped conducting zone located on said sleeve and spaced from said circuit along said sleeve, the end of each one of said cords opposite to its input end, of all the cords present on the sleeve, being connected in a short circuit to said conducting zone.

6. A helical type antenna according to claim 5, wherein said supply circuit of said radiating cords is formed by a meandering line, said transmission line and said ring-shaped conducting zone in short circuit being formed by a patterned layer of metal on a sheet of dielectric material.

7. A method of forming a helical type antenna comprising a sleeve on which are disposed a plurality of spaced apart radiating cords wound thereabout, the ends of said cords adjacent to one end of said sleeve being interconnected by a band of metal, and a strip line to which the other ends of said cords are connected being disposed on said sleeve adjacent to the other end thereof, said method comprising:

a) providing a flexible sheet of a dielectric material with a layer of metal on opposite sides thereof;

b) demarcating, on said sheet, a first zone designed to contain said strip line and a second zone designed to contain said radiating cords and said metal band;

c) removing the metal layer from said second zone on one side of said sheet;

d) patterning the metal layer on the other side of said sheet into, within said second zone, said radiating cords and said metal band, and, within said first zone, said strip line; and e) forming said sheet into the shape of said sleeve.

8. A method according to claim 7 wherein the step (e) is achieved by wrapping said sheet around a member defining the shape of said sleeve.

9. A method according to claim 7, wherein the steps (b) and (c) are accomplished by masking, insolation and chemical attack processes.

10. A method according to claim 7, wherein the step (c) is achieved by means of one and the same mask.

11. A method according to claim 7 wherein, said sleeve is cylindrical, said cords are wound in helices along said sleeve, and said helices are inclined by a preselected angle with reference to any directrix of said sleeve, and wherein said step of providing said sheet comprises stamping said sheet along a contour, the shape of which corresponds to that of a rectangle with a length corresponding to the perimeter of the sleeve, and with a width of a defined value, a parallelogram superimposed on said rectangle, a small side of said parallelogram corresponding to a length side of said rectangle and the long sides of said parallelogram being extensions of the width sides of said rectangle but being disposed at said preselected angle with respect to said length side of said rectangle, and the width of said rectangle plus the height of said parallelogram in a direction parallel to the width of said rectangle comprising the height of said sleeve.

12. A helical type antenna comprising a plurality of radiating cords, said cords being wound onto a sleeve in a rotational shape wherein each radiating cord is formed by a metallized zone in the form of a strip helically wound along a surface of said sleeve, said strips being interleaved along said sleeve and each said strip being distant from the adjacent strip, along a directix of said sleeve, by a predetermined distance, said antenna further comprising a single transmission line to supply all the radiating cords present on the sleeve, said transmission line consisting of a strip line above a ground plane, said strip line and ground plane being located on said sleeve and formed by a meandering line performing both the power distribution function and the function of impedance matching the radiating cords of the antenna.

13. A helical type antenna, as claimed in claim 12, wherein each radiating cord has an input end, each of said input ends being in electrical contact with the strip forming said meandering line at different points along said line, the electrical distance on the line between the input ends of consecutive radiating cords being equal to an odd-numbered multiple of quarter wavelengths of the transmission/reception signal.

* * * * *